US005407100A

United States Patent [19]

Tracy et al.

[11] Patent Number: 5,407,100

[45] Date of Patent: Apr. 18, 1995

[54] DISPENSING APPARATUS WITH A MOVEABLE PLATE

[75] Inventors: Carl A. Tracy, Evanston; Elizabeth A. Ellinger, Skokie, both of Ill.

[73] Assignee: Fluid Management Limited Partnership, Wheeling, Ill.

[21] Appl. No.: 178,513

[22] Filed: Jan. 7, 1994

[51] Int. Cl.[6] ..... B67D 5/46

[52] U.S. Cl. ..... 222/137; 222/333

[58] Field of Search ..... 222/137, 380, 390, 333, 222/276

[56] References Cited

U.S. PATENT DOCUMENTS

| | | |
|---|---|---|
| 869,246 | 10/1907 | Jones . |
| 872,943 | 12/1907 | Jones . |
| 904,371 | 11/1908 | Stewart . |
| 1,030,854 | 6/1912 | Percy . |
| 1,270,835 | 8/1918 | Jersemann . |
| 1,641,280 | 9/1927 | Joslin et al. . |
| 1,836,879 | 12/1931 | Selig et al. . |
| 1,959,694 | 5/1934 | Stevens . |
| 2,185,277 | 1/1940 | Stelzer . |
| 2,207,139 | 7/1940 | Weightman . |
| 2,281,094 | 4/1942 | Chambers . |
| 2,354,573 | 7/1944 | Brock . |
| 2,416,581 | 2/1947 | Harr . |
| 2,428,035 | 9/1947 | Palm . |
| 2,536,277 | 1/1951 | Grieme . |
| 2,606,696 | 8/1952 | Miner . |
| 2,619,116 | 11/1952 | Ralston . |
| 2,645,401 | 7/1953 | Kerr . |
| 2,654,505 | 10/1953 | Fuhrman . |
| 2,665,825 | 1/1954 | Poitras et al. . |
| 2,675,760 | 4/1954 | Hall . |
| 2,675,946 | 4/1954 | Strempel . |
| 2,684,804 | 7/1954 | Huntar et al. . |
| 2,786,419 | 3/1957 | Lynn . |
| 2,821,172 | 1/1958 | Randall . |
| 2,843,044 | 7/1958 | Mashinter . |
| 2,905,361 | 9/1959 | Noall . |
| 2,940,724 | 6/1960 | Sieling . |
| 3,015,415 | 1/1962 | Marsh et al. . |
| 3,023,936 | 3/1962 | Marsh et al. . |
| 3,042,310 | 7/1962 | Franke et al. . |

(List continued on next page.)

FOREIGN PATENT DOCUMENTS

| | | |
|---|---|---|
| 0176140 | 4/1986 | European Pat. Off. . |
| 0353197 | 1/1990 | European Pat. Off. . |
| 419393A1 | 3/1991 | European Pat. Off. . |
| 0283137 | 4/1992 | European Pat. Off. . |
| 2417093 | 10/1979 | France . |
| 3201211 | 7/1983 | Germany . |
| 1310655 | 3/1973 | United Kingdom . |
| WO87/05537 | 9/1987 | WIPO . |
| WO87/05697 | 9/1987 | WIPO . |

OTHER PUBLICATIONS

"Once leaders in microprocessor technology for the colour industry," 4 page brochure, Once—ON Computer Electronics A/S (no date on brochure).

"Once—Fast-Reliable-Weight-Controlled Paint Tinting—Weightint," 3 page brochure (no date on brochure).

"Computint I®," 1 page brochure (no date on brochure).

"CAT 2000®," 1 page brochure, ON Computer Electronics A/S, Denmark (no date on brochure).

"Fastint I—You can count on it for making colours . . . ! Second only to Mother Nature," 6 page brochure, ON Computer Electronics ApS, Copenhagen (no date on brochure).

*Primary Examiner*—Andres Kashnikow
*Assistant Examiner*—Philippe Derakshani
*Attorney, Agent, or Firm*—Fitch, Even, Tabin & Flannery

[57] ABSTRACT

A dispenser for flowable materials such as liquids includes a pair of stationary plates, with a movable plate therebetween. Pumps are mounted between the movable plate and at least one of the stationary plates. A drive system moves the middle plate toward and away from the stationary plates to provide a pumping action. The pumps are mounted to a stationary plate with an adapter, which extends through the plate. A valve assembly is mounted on the reverse side of the stationary plate in registry with the pumps.

14 Claims, 4 Drawing Sheets

U.S. PATENT DOCUMENTS 3,068,650 12/1962 Phillips .
3,242,881 3/1966 Schafer .
3,349,962 10/1967 Levin .
3,390,815 7/1968 Kavan et al. .
3,426,945 2/1969 Harriman .
3,449,387 3/1970 Zippel .
3,545,680 12/1970 Ottaway .
3,589,610 6/1971 Wahlin et al. .
3,791,590 2/1974 Dieter .
3,830,405 8/1974 Jaeger .
3,854,629 12/1974 Blieberger .
3,890,922 6/1975 Nordenholt .
3,895,748 7/1975 Klingenberg .
3,913,797 10/1975 Brym .
3,913,801 10/1975 Wise et al. .
3,932,065 1/1976 Ginsberg et al. .
3,937,440 2/1976 MacGregor et al. .
3,963,377 6/1976 Elliott et al. .
3,979,172 9/1976 Sogo et al. .
3,982,669 9/1976 Moore ..... 222/333
4,004,717 1/1977 Wanke .
4,046,287 9/1977 Hoekstra et al. .
4,047,849 9/1977 Clay .
4,053,012 10/1977 Farmer .
4,105,146 8/1978 Broillard .
4,108,335 8/1978 Hoff et al. .
4,119,058 10/1978 Schmermund .
4,121,413 7/1980 Barber, Jr, et al. .
4,134,689 1/1979 Ahrenskou-Sorenson .
4,142,707 3/1979 Bjorklund .
4,150,769 4/1979 James .
4,155,490 5/1979 Glenn .
4,228,924 10/1980 Gilbret .
4,265,613 5/1981 Oppenberg .
4,314,653 2/1982 Sindoni .
4,350,477 9/1982 Mazal .
4,363,429 12/1982 Schindler .
4,371,096 2/1983 Scholl et al. .
4,394,945 7/1983 Taylor, Jr. .
4,403,764 9/1983 Repplinger .
4,410,108 10/1983 Minard .
4,459,864 7/1984 Cirincione ..... 222/137
4,516,702 5/1985 Schmidt .
4,519,526 5/1985 Hillman .
4,526,215 7/1985 Harrison et al. .
4,597,719 7/1986 Tano .
4,607,998 8/1986 Hawkes .
4,615,902 10/1986 Falcoff et al. .
4,648,810 3/1987 Schippers et al. .
4,653,813 3/1987 Burgdorf .
4,789,245 12/1988 Morbeck .
4,834,548 5/1989 Tempel et al. .
4,878,601 11/1989 Flemming et al. .
4,946,100 8/1990 Flemming et al. .
4,966,467 10/1990 Johnson .
5,083,591 1/1992 Edwards et al. .
5,217,146 6/1993 Neff et al. ..... 222/137
5,305,917 4/1994 Miller et al. ..... 222/137

DISPENSING APPARATUS WITH A MOVEABLE PLATE

BACKGROUND OF THE INVENTION

1. Field of the Invention

The present invention pertains to apparatus for dispensing flowable materials such as liquids.

2. Description of the Related Art

Products made by blending a number of flowable components frequently offer manufacturing advantages over other techniques. For example, in the paint industry, various colors of paint or other coatings are routinely mixed on an as-needed basis. The advantages of these types of distribution systems is becoming well-known and has revolutionized retail sales of paints and other coatings, where custom-mixed coatings are provided on demand for walk-in-customers. Custom blending or tinting of a paint usually requires adding carefully measured quantities of different coloring agents to a paint base. Typically, the tinting materials are dispensed directly into a container of paint base, sequentially, one at a time.

High volume operations, particularly those on an industrial scale, have required faster mixing operations and attention has been paid to speeding up sequential dispensing systems. However, it has also been recognized that alternative types of dispensing systems, most notably simultaneous dispense systems are inherently faster than sequential dispense systems since all or at least a significant number of components are dispensed at one time, simultaneously. One example of a simultaneous dispense machine is described in PCT Published Application No. W087/05697. Pump pistons are mounted between a pair of generally circular plates. A bottom plate is movable and motor driven so as to compress and expand the pump members. Rotary valves are located on top of the pump pistons and are connected to dispense metered amounts of the pump output.

U.S. Pat. No. 4,946,100 describes a second example of a simultaneous dispense machine, wherein a motor-driven screw shaft reciprocates a ball screw back and forth along the shaft axis. An actuating arm carried on the ball screw drives a piston rod to pressurize a hydraulic circuit, which in turn drives a plurality of piston pumps mounted on a part circular base plate, directing pressurized flow to a dispense head.

SUMMARY OF THE INVENTION

It is an object of the present invention to provide paint dispensing apparatus for flowable materials, particularly liquids and mixtures containing liquids.

Another object according to principles of the present invention is to provide a dispense apparatus in which a plurality of liquid components are simultaneously dispensed into a common receptacle.

Another object according to principles of the present invention is to provide a simultaneous dispense apparatus having a plurality of pumps, driven by a common actuator.

A further object according to principles of the present invention is to provide an improved mounting arrangement for pumps and valves within a dispensing apparatus.

These and other objects according to principles of the present invention are provided in dispensing apparatus for dispensing a flowable material, comprising:

a pump including a double-ended housing having a first outlet end and a second remote end;

a valve having an inlet and at least one outlet;

a support wall having first and second opposed sides, and located between the pump and the valve so as to support the pump and the valve, the support wall defining an aperture extending between the opposed sides; and a coupling for coupling the pump and valve together, comprising a double-ended body extending through the aperture and having a first end for connection to the outlet end of the pump, a second end for connection to the valve and defining a through bore for conducting material between the valve and the pump; the coupling including first and second securement means for securing the coupling to opposite sides of the support wall.

DETAILED DESCRIPTION OF THE PREFERRED EMBODIMENT

Figure 1:
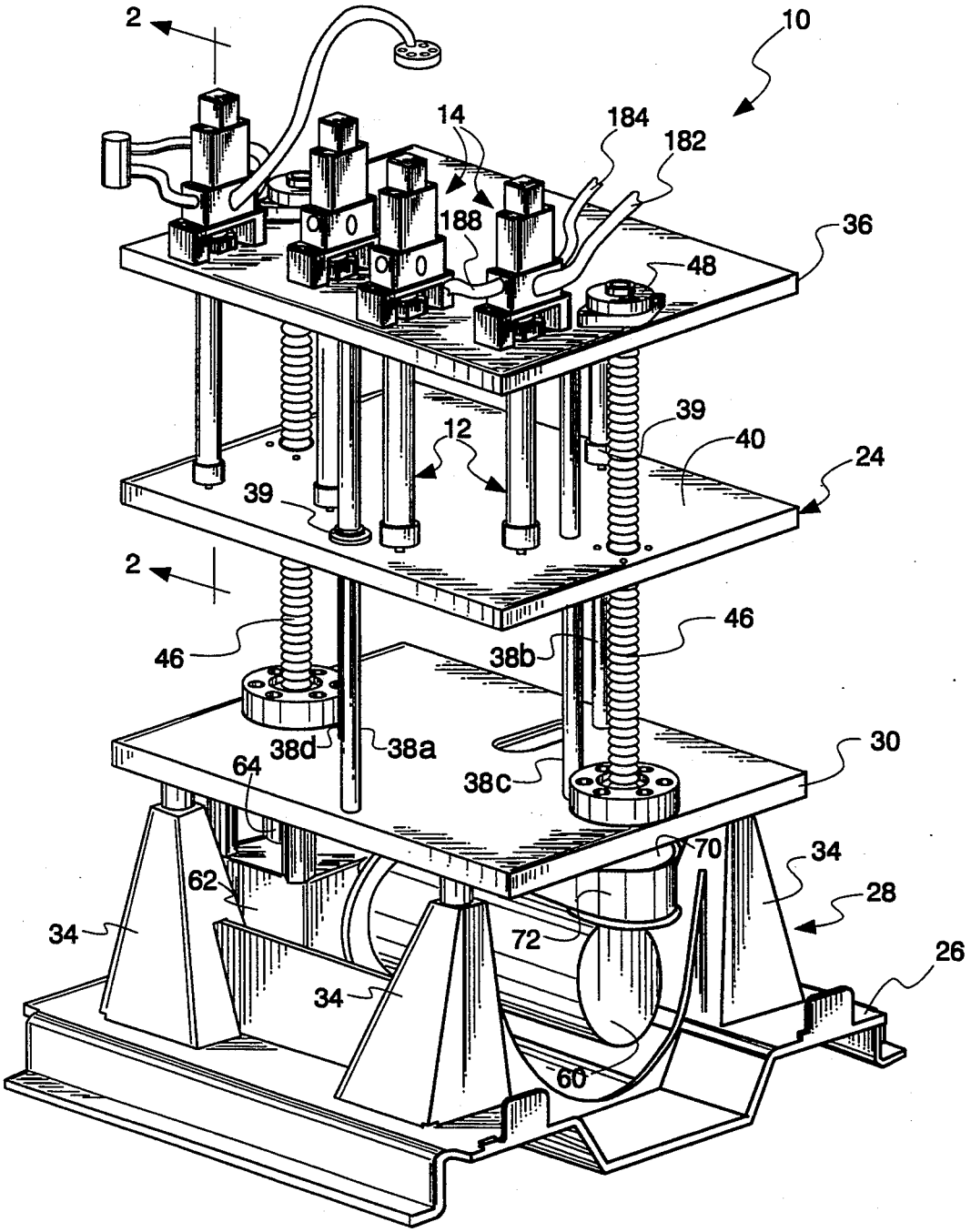
FIG. 1 is a perspective view of apparatus illustrating principles of the present invention.

Referring now the drawings, and initially to FIG. 1, dispensing apparatus is generally indicated at 10. The dispensing apparatus includes a plurality of pump assemblies generally indicated at 12. The plurality of valve assemblies generally indicated at 14. A pump actuator system generally indicated at 24 includes a mounting base 26, and a drive system generally indicated at 28. The drive system is mounted below a base plate 30. The base plate 30 is secured to mounting base 26 by shock-absorbing pylons 34. A top plate 36 is suspended above base plate 30 by a plurality of rigid support rods **38*a*, 38*b*, 38*c*, 38*d*, fixed at their bottom ends to base plate 30 and at their top ends to top plate 36. Traveling plate 40 is guided along support rods 38*a*, 38*b*, between the top and base plate 36, 30. As will be seen herein, the pump assemblies are mounted between traveling plate 40 and base plate 30, with the pump plungers attached to the traveling plate 40**.

In the preferred embodiment, four support rods 38 are located along mutually perpendicular center lines extending base plate and top plate 36. The four support rods 38 are maintained parallel to one another, and are fixedly secured to base plate 30 and top plate 36. In FIG. 1, the support rods **38*a* and 38*b* guide plate 40 using linear bearings 39 mounted in plate 40**.

A framework could be extended from base 30 if desired to support the upper plate 36. However, it is generally preferred that the top plate 36 be supported by support rods 38 confined within the outer peripheries of top plate 36 and base plate 30. It is important that the parallelism and spacing of support rods 38 be carefully maintained so as to not only provide smooth and trouble free operation of the traveling plate 40, but also to maintain synchronism of the various pumps during a dispensing operation.

Referring again to FIG. 1, the pump actuator system 24 further comprises a pair of lead screws or threaded drive screws 46, which have generally vertical central axes and which have an upper end coupled to top plate 36 by bearings 48, and which have bottom ends extending below base plate 30, with the lead screws 46 passing through suitably sized bearings in base plate 30, so as to be freely rotatable in the base plate and so as to transfer axial force. The lead screws 46 also pass through suitably sized apertures in traveling plate 40. The traveling plate 40 is translated, and force is transmitted through it, by the rotation of the lead screws 46, which are coupled to plate 40 by a lead screw ball nut fastened to plate 40. In the preferred embodiment, the diameter pitch and rotational speed of drive screws 46 are substantially identical from one drive screw to another.

The drive system 28 further includes a drive motor 60 having an output shaft coupled to a gear train contained in housing 62. Gear train and housing 62 has a vertical output shaft 64 secured to the bottom end of one drive screw 46. In the preferred embodiment, a shaft encoding system is contained either in housing 62 or in the housing the motor 60 to provide control signals for dispensing operations.

A drive sprocket 70 is coupled to outward shaft 64 by a timing belt 72 to provide synchronized rotational drive for the remaining drive screw 46 located remote from motor 60. The belt 72 is preferably of the notched or tooth-belt type to provide positive, reliable timing between the drive screws. When motor 60 is energized, the gear train and housing 62 is driven to rotate output shaft 64 in a desired direction causing the traveling plate 40 to move up or down. This in turn simultaneously drives both drive screws 46 in the same direction, with the same speed, and "in-phase" with one another. As a result, the opposed ends of traveling plate 40, (i.e., adjacent each drive screw) are displaced identical amounts in vertical directions with a precision sufficient to maintain substantial parallelism with the top and base plates 36, 30.

The drive system 28 is the same as that shown in commonly-assigned U.S. patent application Ser. No. 07/978,924, filed Nov. 19, 1992 now U.S. Pat. No. 5,305,917, the disclosure of which is herein incorporated by references as if fully set forth herein. As will be seen herein, the present invention provides advantages for the fluid-handling components, for example, the pumps and valves of dispensing apparatus 10 which are associated with pump actuator pump.

Figure 2:
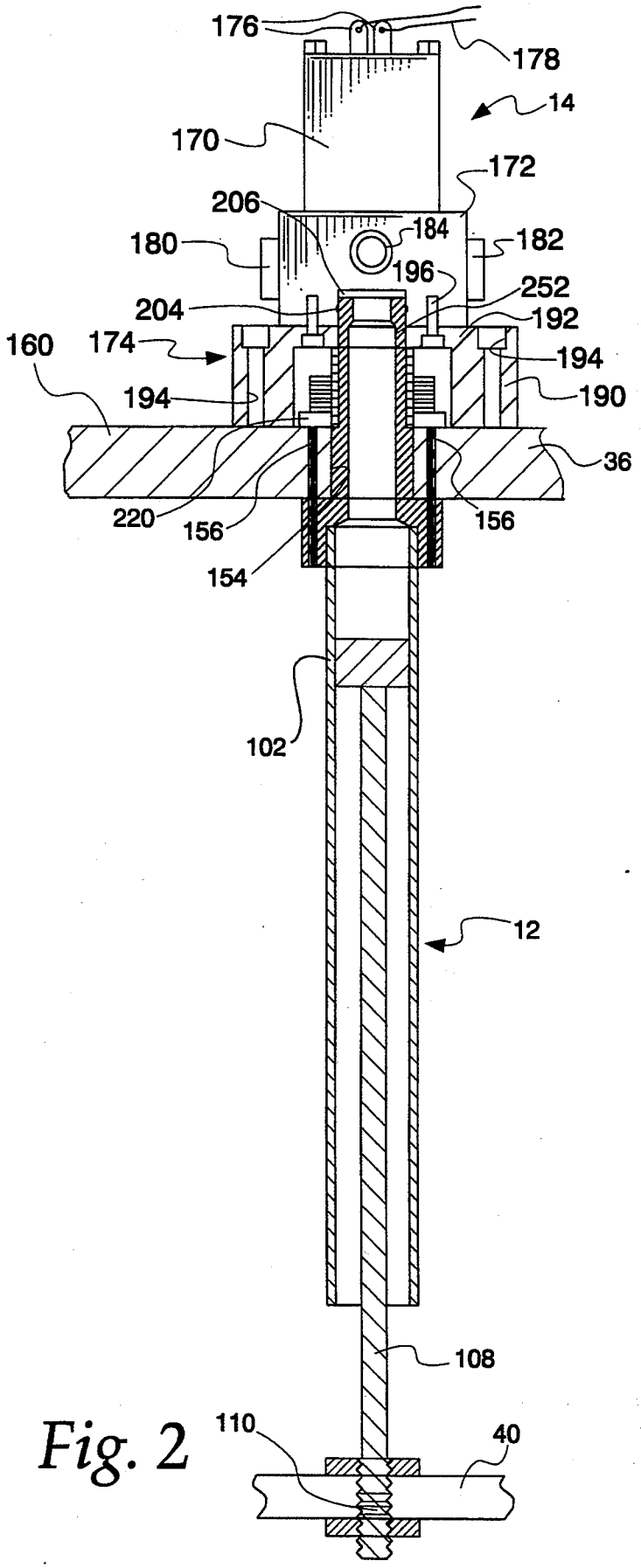
FIG. 2 is a cross-sectional view taken along the line 2—2 of FIG. 1.
Figure 5:
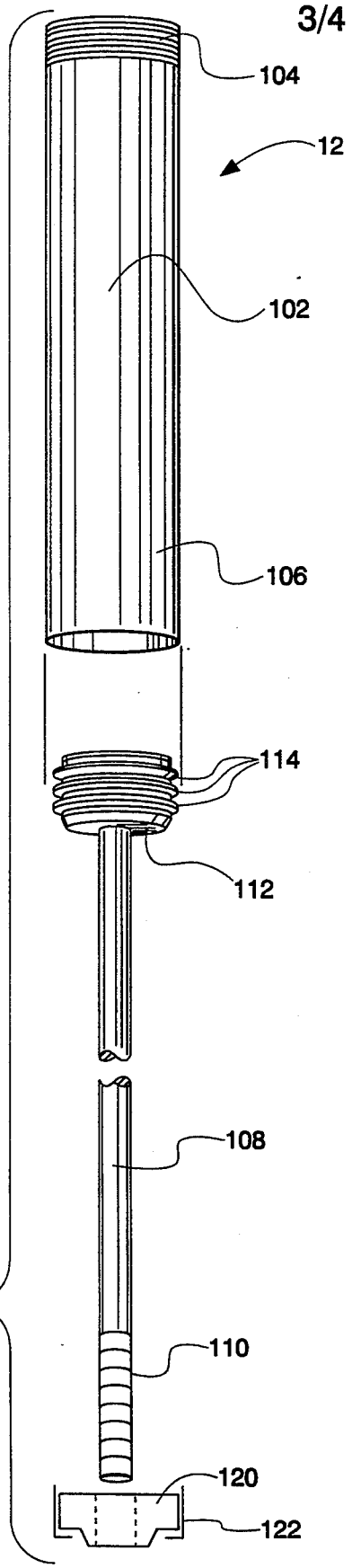
FIG. 5 is an exploded view of the pump assembly shown in the preceding figures.
Figure 6:
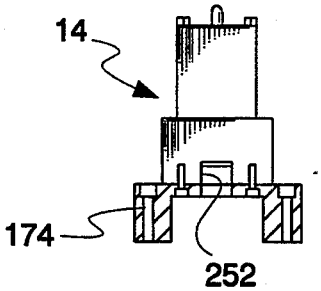
FIG. 6 is a front elevational view of a valve assembly shown in the preceding figures.
Figure 9:
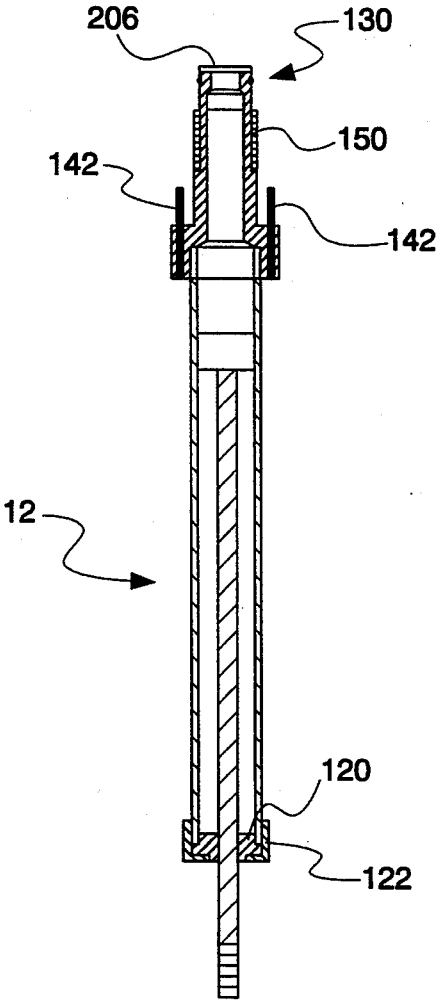
FIG. 9 shows the pump assembly of FIG. 5 mated to the adapter of FIG. 3.

Referring now to FIGS. 2 and 5, pump assembly 12 includes a pump housing 102 preferably comprising a generally cylindrical tube with an upper end 104 having external threads formed therein, and an opposed lower end 106. A pump shaft 108 has a lower threaded end 110 and an upper enlarged end 112 carrying a plurality of resilient plunger seals 114. Referring additionally to FIG. 9, an alignment bushing 120 is disposed within housing 102 and includes an internal through-bore for closely dimensioned engagement with pump shaft 108. Alignment bushing 120 is preferably formed of resilient lubricated material such as a suitable plastics composition. A retainer collar 122 is inserted over the end 106 of housing 102 and is secured thereto by a set screw or other conventional fastening means. In the preferred embodiment, the major portion of pump assembly 12 is of conventional construction, commercially available from the assignee of the present invention as parts available in its manual dispenser line. The alignment bushing 120 and retaining collar 122 are added to the pump assembly to facilitate pump alignment.

Figure 4:
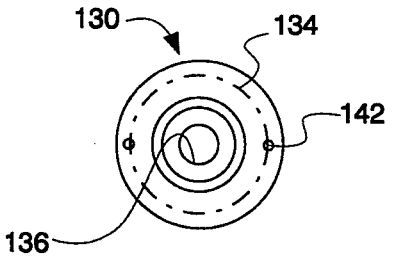
FIG. 4 is a top plan view of the adapter member shown in FIG. 3.
Figure 3:
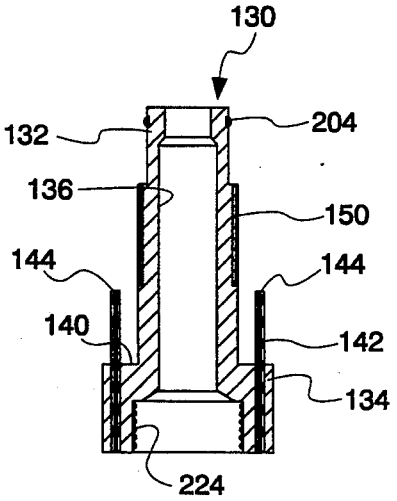
FIG. 3 shows a portion of FIG. 2 on an enlarged scale, illustrating an adapter member.

As illustrated in FIGS. 1 and 2, pump assembly 12 is mounted between traveling plate 40 and top plate 36, with the bottom end of pump shaft 108 fastened with jam nuts to traveling plate 40, and the upper end of housing 102 coupled to top plate 36. The valve assemblies 14 are mounted above their respective pump assemblies, being supported by top plate 36. An adapter generally indicated at 130 is illustrated in FIGS. 3 and 4 and can be made of a variety of suitable materials, preferably a metal alloy. Adapter 130 has a generally cylindrical configuration, with an upper end 132 and an enlarged lower end 134. A through-bore 136 extends through the adapter body and, as can be seen in FIG. 3, has a series of three step portions growing successively larger toward the bottom of the adapter. A shoulder with an upper seating surface 140 is formed at the lower end of adapter 130. Vertically extending apertures are formed in the shoulder to receive slotted spring pins 142 having upper ends 144 which extend above the shoulder of adapter 130. External threads 150 are formed above the shoulders, being located radially inward of pins 142.

Referring again to FIG. 2, an aperture 154 is formed in plate 36 to receive the upper portion of adapter 130. Apertures 156 are formed on either side of aperture 154 and are dimensioned, as indicated in FIG. 2, to receive pins 142 with a friction fit. As desired, the apertures 156 can extend through plate 36, communicating with the upper surface 160 of the plate. The preferred embodiment, the aperture 154 is sized substantially larger than the central portion of adapter 130 (that portion including the external threads 150 and the external surface of the adapter immediately therebelow). Thus, the aperture 154 need not be accurately located with respect to top plate 36. As can be seen in FIG. 4, the preferred embodiment employs a pier of pins 142 and the angular position of these pins with respect to the center line of the pump assembly is arbitrary. Accordingly, the holes 156 which receive pins 142 need be made accurate only with respect to their spacing, resulting in further advantages in economy.

The valve assembly 14 is comprised of three principle components: a solenoid 170, a valve 172, and a mounting platform 174. The solenoid 170 includes electrical terminals 176 for connection to an external circuit through wires 178. Referring additionally to FIG. 1, valve 172 includes inlet/outlet orifices 180, 184 and outlet orifice 182. Material circulates between orifices 180 and 182 during movement of traveling plate 40 and under control of solenoid 170 diverts the flow through valve 172 to metered outlet 182 for disposition at a dispense head of the type described in the aforementioned commonly-assigned U.S. patent application Ser. No. 07/978,924 now U.S. Pat. No. 5,305,917. In the preferred embodiment, solenoid 170 and valve 172 are commercially available as a combined unit. One example of the combined unit is Part No. 121-F-$\frac{1}{4}$-F-PV-$\frac{3}{8}$-24/DC available from the Burkert Corporation, located in Orange, Calif.

Figure 8:
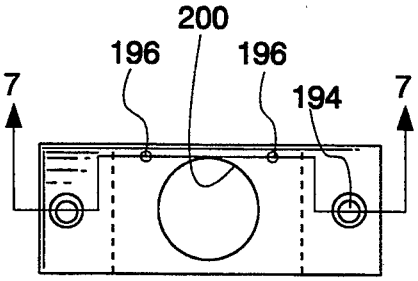
FIG. 8 is a top plan view of the mounting base of FIG. 7.
Figure 7:
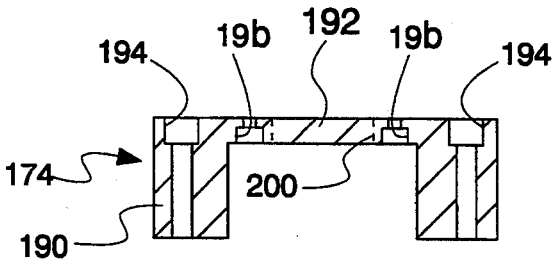
FIG. 7 shows the mounting base portion on FIG. 6 in greater detail.

The mounting bracket 174 includes a square offset 190. Referring to FIGS. 7 and 8, adapter 174 has a generally flat upper surface interrupted by through holes 194 which receive threaded fasteners for securement to top plate 36. A central aperture 200 receives the upper portion of adapter 130. As shown in FIG. 3, the upper end of adapter 130 includes an O-ring gasket 204. A second, flat gasket 206 is located between the end of the adapter 130 and the valve 172, FIG. 2.

Installation of the pump and valve assemblies will now be described with reference to FIG. 2. As mentioned, through-hole 154 and pin-receiving holes 156 are formed in plate 36 for each pump and valve assembly. However, the hole 154 may be oversized and need not be accurately located. The pin-receiving holes 156 can be located at any angle with respect to the central axis of the pump or valve assemblies and only their spacing from one another must be held to a close dimension. As seen in the bottom portion of FIG. 3, the lower end of through-hole 136 is threaded at 224. Interior threads 224 mate with the upper threaded end 104 of pump body 102.

After the pump assembly is fitted to adapter 130, the upper end of adapter 130 is inserted through hole 154 in plate 36, and pins 142 are aligned with holes 156. The upper seating surface 140 of adapter 130 is brought into contact with plate 36 and nut fastener 220 is mated with the threads 150 of adapter 130 to secure the adapter and hence pump assembly to top plate 36. The solenoid and valve units 170 and 172 are mounted to bracket 174 with threaded fasteners received in apertures 196 formed in the mounting bracket. Gasket 206 is fitted to the upper end of adapter 130 and mounting bracket 174 is fitted over the upper end of the adapter, with the lower mating surface 252 seating against gasket 206. Fasteners received in apertures 194 secure the mounting bracket solenoid and valve in position a top plate 36.

The pins 142, when received in apertures 156, help locate the pump assembly with respect to the apertures in plate 40 receiving the threaded ends of pump shafts 108.

As mentioned, the spacing and location of holes 156 in plate 36 must be accurately controlled. In addition, it is important to accurately control the orientation of the axis of pump assembly 12 in a direction parallel to the travel of plate 40 using the surface 140 interface with plate 36. In a preferred embodiment, this direction is generally perpendicular to the major surfaces of top plate 36 and hence to the major surfaces of traveling plate 40 and the upper surface of bottom plate 30.

As it will now be appreciated, manufacturing costs associated with apparatus 10 are significantly reduced from prior art dispensing apparatus. The number of components in apparatus is significantly reduced, as is the number and accuracy of machining operations to be performed on plates 30, 36 and 40. Further, the alignment of the pump and valve assemblies are quickly and easily obtained despite the economical construction.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Dispensing apparatus for dispensing a flowable material, comprising:

a pump including a double-ended housing having a first outlet end and a second remote end;

a valve having an inlet and at least one outlet;

a support wall having first and second opposed sides, and located between the pump and the valve so as to support the pump and the valve, the support wall defining an aperture extending between the opposed sides; and a coupling for coupling the pump and valve together, comprising a double-ended body extending through the aperture and having a first end for connection to the outlet end of the pump, a second end for connection to the valve and defining a through bore for conducting material between the valve and the pump; the coupling including first and second securement means for securing the coupling to opposite sides of the support wall.

2. The apparatus according to claim 1 wherein said coupling has an enlarged end forming a shoulder for engaging the first side of the support wall.

3. The apparatus according to claim 2 further comprising locating pins extending outwardly from said shoulder, and the first side of the support wall defines recesses to receive the pins.

4. The apparatus according to claim 1 wherein said coupling body has a cylindrical outer wall portion extending through aperture and terminating in a free end spaced beyond the second side of the support wall.

5. The apparatus according to claim 4 further comprising a threaded fastener and wherein said cylindrical outer wall portion is threaded to receive the threaded fastener, with the threaded fastener engaging the second side of the support wall.

6. The apparatus according to claim 5 further comprising a mounting collar between the valve and the second side of the support wall, with first means for attachment to the valve and second means for attachment to the support wall, said mounting collar defining an aperture for passage of the coupling body free end therethrough.

7. The apparatus according to claim 6 wherein the valve includes a recess aligned in registry with the aperture of the collar so as to receive the outlet end of the pump.

8. Dispensing apparatus for dispensing a flowable material, comprising:

a pump;

a valve having an inlet and at least one outlet;

a supporting frame;

an upper plate carried on the supporting frame, having opposed sides, and located between the pump and the valve so as to support the pump and the valve, the upper plate defining an aperture extending between the opposed sides;

a lower plate carried on the supporting frame below the upper plate, for movement toward and away from the upper plate;

means for moving the lower plate toward and away from the upper plate;

the pump including a double-ended housing having a first outlet end attached to the lower plate and a second remote end; and a coupling for coupling the pump and valve together, comprising a double-ended body extending through the aperture and having a first end for connection to the outlet end of the pump, a second end for connection to the valve and defining a through bore for conducting material between the valve and the pump; the coupling including first and second securement means for securing the coupling to opposite sides of the support wall.

9. The apparatus according to claim 8 wherein said coupling body has a cylindrical outer wall portion extending through aperture and terminating in a free end spaced beyond the second side of the support wall.

10. The apparatus according to claim 9 further comprising a threaded fastener and wherein said cylindrical outer wall portion is threaded to receive the threaded fastener, with the threaded fastener engaging the second side of the support wall.

11. The apparatus according to claim 10 further comprising a mounting collar between the valve and the second side of the support wall, with first means for attachment to the valve and second means for attachment to the support wall, said mounting collar defining an aperture for passage of the coupling body free end therethrough.

12. The apparatus according to claim 11 wherein the valve includes a recess aligned in registry with the aperture of the collar so as to receive the outlet end of the pump.

13. The apparatus according to claim 8 wherein said coupling has an enlarged end forming a shoulder for engaging the first side of the support wall.

14. The apparatus according to claim 13 further comprising locating pins extending outwardly from said shoulder, and the first side of the support wall defines recesses to receive the pins.

* * * * *